US005944442A

United States Patent [19]

Roush et al.

[11] Patent Number: 5,944,442

[45] Date of Patent: Aug. 31, 1999

[54] MANHOLE EXTENDER RING SYSTEM AND METHOD OF USE

[75] Inventors: Warren H. Roush; Anne F. Roush, both of Dacula, Ga.

[73] Assignee: Anjowa, Inc., Dacula, Ga.

[21] Appl. No.: 08/797,590

[22] Filed: Feb. 7, 1997

Related U.S. Application Data

[63] Continuation-in-part of application No. 08/645,247, May 13, 1996, abandoned.

[51] Int. Cl.[6] ..... E02D 29/14

[52] U.S. Cl. ..... 404/26; 52/20

[58] Field of Search ..... 404/25, 26; 52/19, 52/20

[56] References Cited

U.S. PATENT DOCUMENTS

| | | | |
|---|---|---|---|
| 3,408,778 | 11/1968 | Mason | 52/20 |
| 3,773,428 | 11/1973 | Bowman . | |
| 4,121,390 | 10/1978 | Hall et al. | 404/26 X |
| 4,149,816 | 4/1979 | Piso . | |
| 4,273,467 | 6/1981 | Cronk . | |
| 4,469,467 | 9/1984 | Odill et al. | 404/25 |
| 4,925,337 | 5/1990 | Spiess et al. . | |
| 4,976,568 | 12/1990 | Hess . | |
| 5,044,818 | 9/1991 | Pritchard | 404/25 X |
| 5,205,668 | 4/1993 | Adams . | |
| 5,211,504 | 5/1993 | Trudel . | |
| 5,230,583 | 7/1993 | Johnson | 404/25 |
| 5,281,046 | 1/1994 | Svirklye | 404/26 |
| 5,360,131 | 11/1994 | Phillipps et al. . | |
| 5,513,926 | 5/1996 | Prescott | 404/26 |
| 5,536,110 | 7/1996 | Tompkins et al. | 404/26 X |
| 5,549,411 | 8/1996 | Hawkins | 404/26 X |

FOREIGN PATENT DOCUMENTS

| | | | |
|---|---|---|---|
| 3016401 | 2/1981 | Germany | 52/20 |

*Primary Examiner*—James A. Lisehora
*Attorney, Agent, or Firm*—Hinkle & Associates, P.C.

[57] ABSTRACT

A manhole extender ring system 2 comprises an annular base member 4 having a flange 24 disposed therein, an annular insert member 32 slidably disposed within the base member 4 and supported by the flange 24, an annular ring member 44 having a ring top surface 46 slidably engaging the insert member 32 and supported by the base member 4 and a cover member 62 having a cover top surface substantially flush with the ring top surface 46 slidably disposed within the ring member 44 and supported by the insert member 32. The ring member 44 is removably mounted to the base member 4 by use of a variable, elongate stabilizer bracket 70 having a J-shaped end 78 and a C-shaped end 86. The J-shaped end 78 removably engages a shoulder 60 of the ring member 44 and the C-shaped end 86 removably engages the flange 24. Pins 98 may be disposed on the insert and ring top surfaces to removably engage receiving bores disposed on the insert and ring bottom surfaces when the insert and ring members are in a multiple stacked relationship.

11 Claims, 7 Drawing Sheets

MANHOLE EXTENDER RING SYSTEM AND METHOD OF USE

RELATED PATENT DOCUMENTS

This is a continuation-in-part of U.S. application Ser. No. 08/645,247 filed May 13, 1996, by Warren H. Roush and Anne F. Roush, entitled "Manhole Extender Ring System And Method Of Use", now abandoned.

BACKGROUND OF THE INVENTION

I. Field of the Invention

The present invention relates generally to the field of roadway manhole devices. More particularly, the present invention relates to a manhole extender ring system which vertically adjusts the top surface of a manhole cover to be flush with the roadway surface regardless of the grade.

II. Description of the Related Art

Roadways often cross telephone lines, electrical lines and various types of devices. Typically, maintenance workers gain access to these lines and devices via manholes. It is common for manholes to have a brick or concrete foundation with an annular, metallic support having a cover mounted to the foundation and embedded within the roadway surface. The cover generally is flush with the roadway surface to provide a smooth and safe passage for vehicles using the roadway. However, roadway surfaces have limited lifetimes due to climatic degradation and wear from vehicle use. Compensating for these effects, the roadways are periodically resurfaced, requiring the roadway workers to raise the support of the manhole unit to the new roadway surface level.

To raise the support it generally takes 2 to 4 workers several hours of labor to jackhammer out the roadway surface material, such as asphalt and concrete, around the support. Normally, the manhole is not raised until after the new roadway has been laid. This, of course, destroys a portion of the new roadway. Occasionally, portions of the foundation are removed. After the support has been removed, the foundation is raised by a height equivalent to the thickness of the new roadway surface with new bricks and/or mortar. The mortar is allowed to cure for a number of hours, requiring the use of barricades and sometimes the detouring of traffic.

There are many types of manhole support devices capable of modification to accommodate the addition of new roadway surfaces over old roadway surfaces. Several are described in U.S. Pat. Nos. 4,149,816, 4,273,467, 4,925,337, 5,205,668, 5,211,504, and 5,360,131.

Described in U.S. Pat. No. 3,773,428 by Bowman is an adjustable manhole cover support. The device has a frame and a peripheral manhole adjusting ring disposed on the frame. The ring is adjusted vertically and secured within the frame by set screws or spacers to raise or lower a manhole cover. The vertical adjustment is limited by the length of the set screws and a gap is created between the frame and the ring when the ring is adjusted away from the frame.

A height adjustable road manhole cover described in German Patent Number 30 16 401 by Lindner describes a topping piece with end face steps for mounting a lid and a holder for a lid-securing piece. A pair of compensating rings raise the vertical height of the holder and the lid. The holder is secured by use of set screws.

Described in U.S. Pat. No. 4,976,568 by Hess is a device for raising the level of a manhole cover. The device has a frame, a ring having a mounting surface adapt to sit on the top of the frame and a manhole cover. As with Bowman and Lindner, the ring is secured to the frame by set screws.

An adjustable manhole cover assembly described in U.S. Pat. No. 5,044,818 by Pritchard has an annular frame and an annular sleeve member repositioned so as to rest on a first annular adjustment ring to adjust the system to the desired height. The sleeve member is positioned within the frame and is secured by an outwardly projecting flange which is captured by the roadway surface.

SUMMARY OF THE INVENTION

In accordance with the present invention and the contemplated problems which have and continue to exist in this field, the objectives of this invention are to provide a manhole extender ring system which provides:

- a ring member and an insert member readily adaptable to an embedded manhole base member for adjusting the vertical height of a cover member to be substantially flush with a roadway surface;
- stackable ring and insert members for vertical height adjustments due to periodic roadway resurfacing;
- ring and insert members having variable heights to accommodate roadway resurfacing thicknesses which are not uniform;
- ring and insert members forming a slope with respect to the base member to adjust for roadway surfaces which are not horizontal;
- ring and insert members that have pins to provide stability while in use;
- a system which requires few man-hours and quickly raises the vertical height of the cover member without disturbing a manhole foundation supporting the base member; and
- a stabilizer bracket to quickly mount the ring member to a base member.

This invention accomplishes the above and other objectives and overcomes the disadvantages of the prior art by providing a manhole extender ring system that is simple in design and construction, inexpensive to fabricate, and easy to use. A manhole extender ring system comprises an annular base member having a flange disposed therein, an annular insert member slidably disposed within the base member and supported by the flange, an annular ring member having a ring top surface slidably engaging the insert member and supported by the base member and a cover member having a cover top surface substantially flush with the ring top surface slidably disposed within the ring member and supported by the insert member. The ring member is removably mounted to the base member by use of a variable, elongate stabilizer bracket having a J-shaped end and a C-shaped end. The J-shaped end removably engages a shoulder of the ring member and the C-shaped end removably engages the flange. The stabilizer bracket is disposed within inner and outer channels of the ring and insert members, respectively, thereof. The ring and insert members are stackable on one another to raise the vertical height of the cover member due to successive roadway resurfacing projects. Pins are provided with the ring and insert members to provide vertical stability when stacked so that the stabilizer bracket is free from shearing forces. Further, the ring and insert members can slope to remain substantially flush with a sloped roadway surface.

It is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Other objects, advantages and capabilities of the invention will become apparent from the following description taken in conjunction with the accompanying drawings showing the preferred embodiment of the invention.

BRIEF DESCRIPTION OF THE DRAWINGS

The invention will be better understood and the above objects as well as objects other than those set forth above will become apparent when consideration is given to the following detailed description thereof. Such description makes reference to the annexed drawings wherein.

DESCRIPTION OF THE PREFERRED EMBODIMENTS

Figure 1:
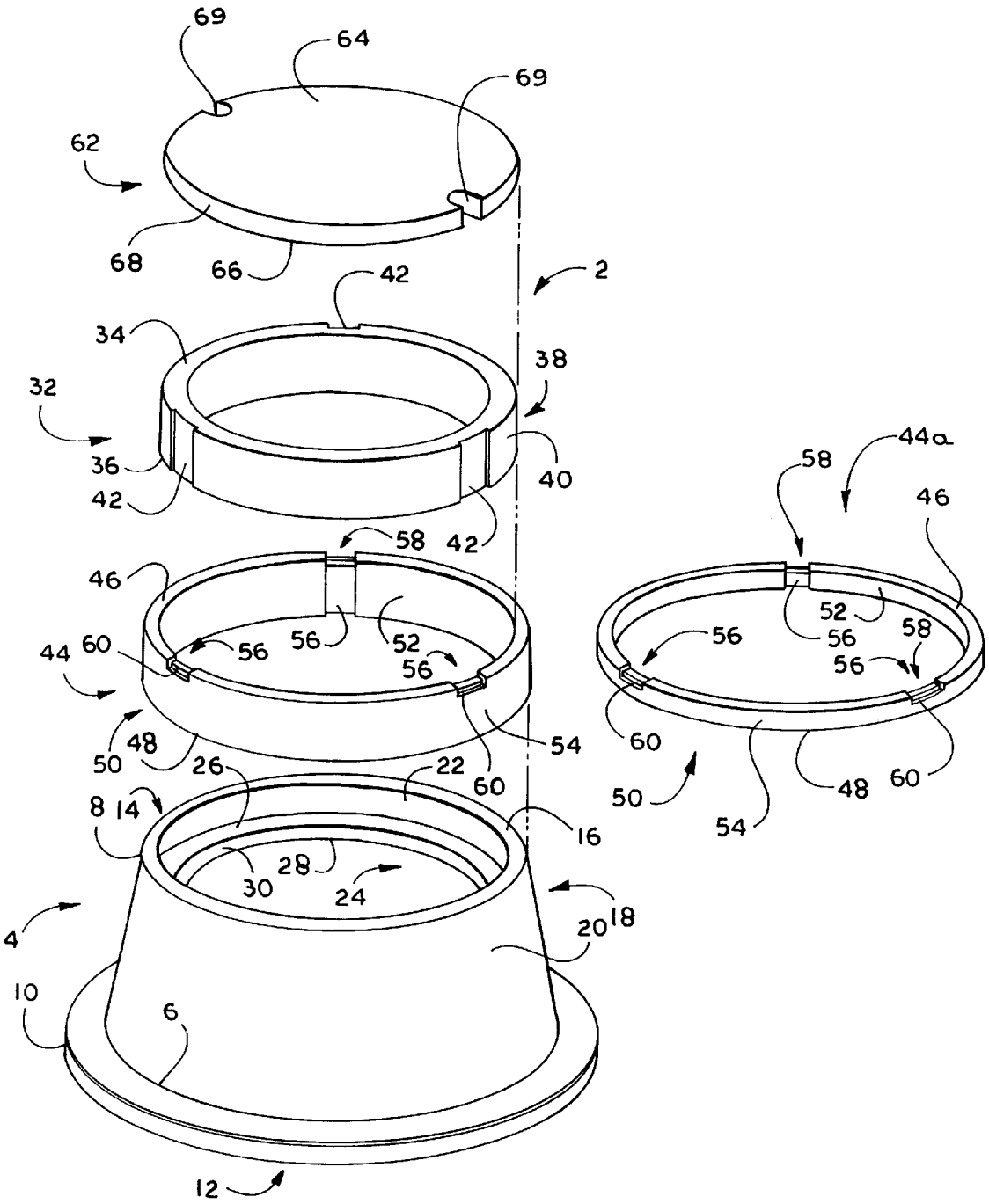
FIG. 1 is an exploded, perspective view of an embodiment of a manhole extender ring system made in accordance with the present invention.

For a fuller understanding of the nature and desired objects of this invention, reference should be made to the following detailed description taken in connection with the accompanying drawings. Referring to the drawings wherein like reference numerals designate corresponding parts throughout the several figures, reference is made first to FIG. 1. FIG. 1 of the drawings illustrates a manhole extender ring system 2.

Referring to FIGS. 1 through 3 and 6, the manhole extender ring system 2 originates with a base member 4 having a base bottom 6, a base top 8 and a longitudinal axis between the base bottom and top 6 and 8. Although shape may be varied, it is customary and preferred for the base member 4 to have an annular shape. A foot 10 depends from the base bottom 6 to engage a manhole foundation (not shown). Protruding horizontally and outwardly from the base bottom 6, the foot 10 has a foot bottom surface 12 which directly contacts the foundation. At the base top 8 is a rim 14 having a rim surface 16. In the preferred embodiment, the foot bottom surface 12 is substantially parallel to the rim surface 16. It is intended, but not required, for the base member 4 to be embedded within a roadway surface (not shown) such that the rim 14 is substantially flush with the roadway surface. Disposed between the foot 10 and the rim 14 is a base wall 18 having a wall outer surface 20 and a wall inner surface 22. Preferably, the base wall 18 has a frusto-conical shape, thereby additionally stabilizing the base member 4 in contact with the foundation when roadway surfacing materials contact the wall outer surface 20. Extending from the wall inner surface 22 outwardly toward the longitudinal axis of the base member 4 and substantially parallel to the rim surface 16 is a flange 24. The flange 24 has a flange upper surface 26, a flange lower surface 28 and a flange edge 30 disposed therebetween.

Figure 2:
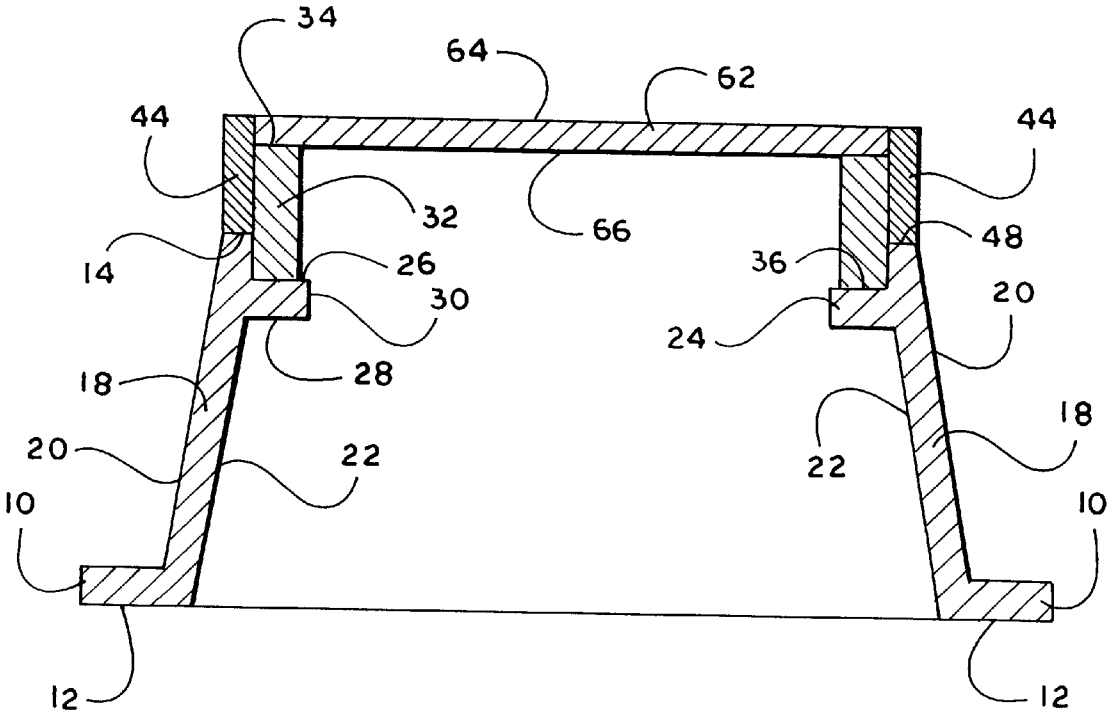
FIG. 2 is a side elevation and section view taken along the diameter of a base member of the present invention.
Figure 3:
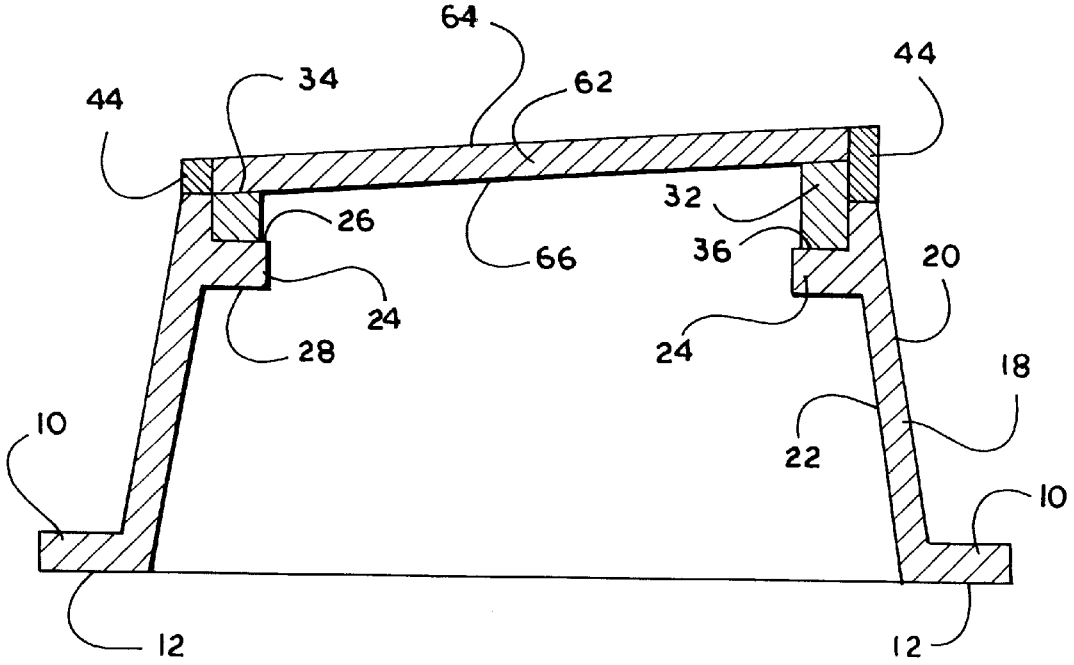
FIG. 3 is a side elevation and section view taken along the diameter of a base member showing an insert member and a ring member having a slope with respect to the base member of the present invention.

An insert member 32 next comprises the manhole extender ring system 2. The insert member 32 has an insert top surface 34, an insert bottom surface 36 and an insert wall 38 dispose between the insert top and bottom surfaces 34 and 36. External to the insert member 32, the insert wall 38 has an insert outer surface 40. As shown in FIGS. 2 and 3, the insert outer surface 40 is adapted to slidably and removably engage the wall inner surface 22. While the insert member 32 engages the base member 4, the flange upper surface 26 supports the insert bottom surface 36. It is readily apparent that the insert member 32 may extend above the rim surface 16 while engaging the base member 4. The distance between the insert top surface 34 and the foot bottom surface 12 defines a first height, which may be greater than the height of the base member 4.

As with the base member 4, the shape of the insert member 32 should have a compatible shape to that of the base member 4 so that the flange upper surface 26 is capable of supporting the insert bottom surface 36. Preferably, the insert member 32 is annularly shaped. To accommodate for varying roadway surface thicknesses, the insert member 32 is vertically adjustable. That is, the height of the insert wall 38 is selected from a predetermined value which approximates the thickness of the new roadway surface. In the preferred embodiment, the insert outer surface 40 has three, equally-distant spaced outer channels 42.

A ring member 44 removably engages the base member 4 and the insert member 32. The ring member 44 has a ring top surface 46, a ring bottom surface 48 and a ring wall 50. Internal to the ring wall 50 is a ring inner surface 52, and external to the ring wall 50 is a ring outer surface 54. Preferably, disposed on the ring inner surface 52 are three, equal distantly-spaced inner channels 56. The ring inner surface 52 is adapted to slidably and removably engage the insert outer surface 40. While the ring member 44 engages the base and insert members 4 and 32, the rim surface 16 removably supports the ring bottom surface 48, and the outer channels 42 and the inner channels 56 are in a juxtaposed relationship to one another. It is necessary for the ring member 44 to extend above the insert top surface 34 while engaging the base member 4, and the distance between the ring top surface 46 and the foot bottom surface 12 defines a second height, which is also greater than the first height. It is preferred for the ring top surface 46 to be substantially flush with the roadway surface.

Like the insert member 32, the shape of the ring member 44 may be varied, except the ring member 44 has a compatible shape to that of the base member 4, allowing the ring bottom surface 48 to be supported by the rim surface 16. Preferably, the ring member 44 has an annular shape. Also, to accommodate for varying roadway surface thicknesses, the ring member 44 is vertically adjustable, as shown by the alternate ring member 44*a* in FIG. 1. That is, the height of the ring member 44 is preferably the same as and determined in the same manner as the insert member 32.

Abutting and adjacent to each inner channel 56 is a groove 58 on the ring top surface 46. Within each groove 58 is a shoulder 60 that is located inwardly from the ring outer surface 54 and below the ring top surface 58.

A cover member 62 removably engages the insert member 32 and the ring member 44. The cover member 62 has a substantially planar cover top surface 64 that is preferably substantially flush with the ring top surface 46. Supporting the cover member 62 is a cover bottom surface 66 which removably engages the insert top surface 34. A cover edge surface 68 slidably and removably engages the ring inner surface 52. When placed within the base member 4, the cover bottom surface 66 rests upon the flange upper surface 26 and the cover top surface 64 is substantially flush with the rim surface 16. The cover member 62 may have any shape that is compatible with the base member 4, the insert member 32 and the ring member 44. To determine the preferred thickness of the cover member 62, take the difference between the second height and the first height. Preferably, the cover member 62 has a disc shape and a pair of openings 69 to assist an individual in removing the cover member 62.

Figure 4:
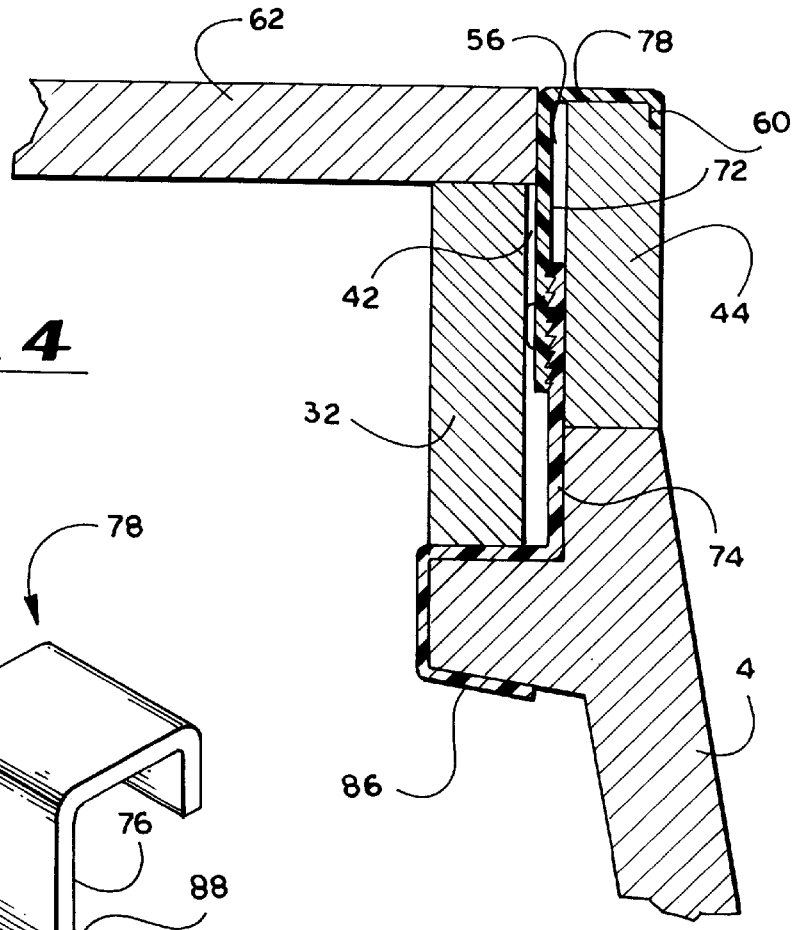
FIG. 4 is a partial and sectional elevation view taken along the diameter of the base member showing a stabilizer bracket mounting the ring member to the base member of the present invention.
Figure 5:
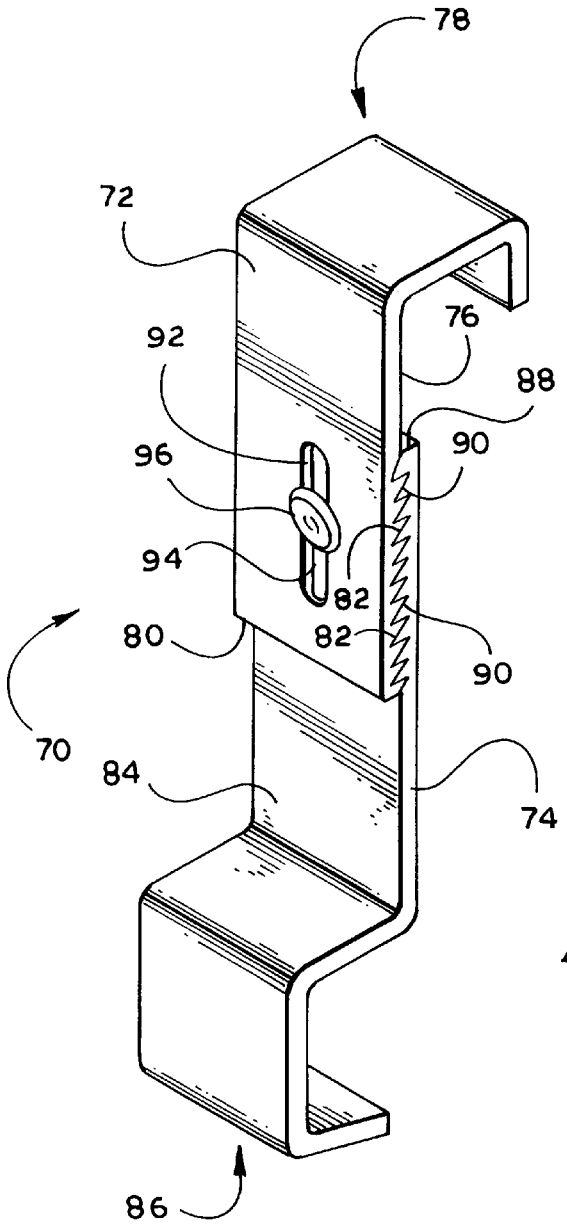
FIG. 5 is a perspective view of an embodiment of the stabilizer bracket of the present invention.
Figure 8:
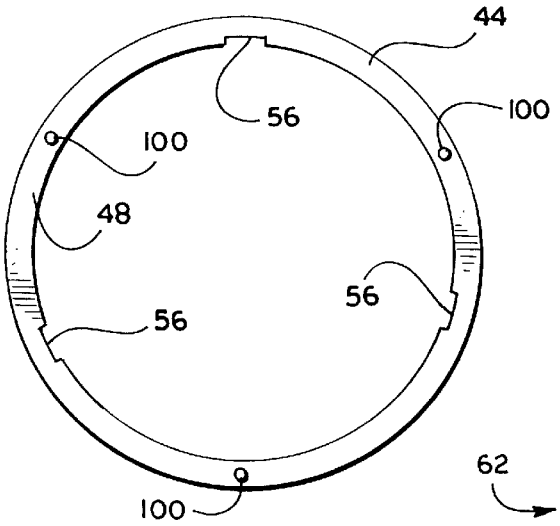
FIG. 8 is a bottom view of an embodiment of the ring member made in accordance with the present invention.
Figure 7:
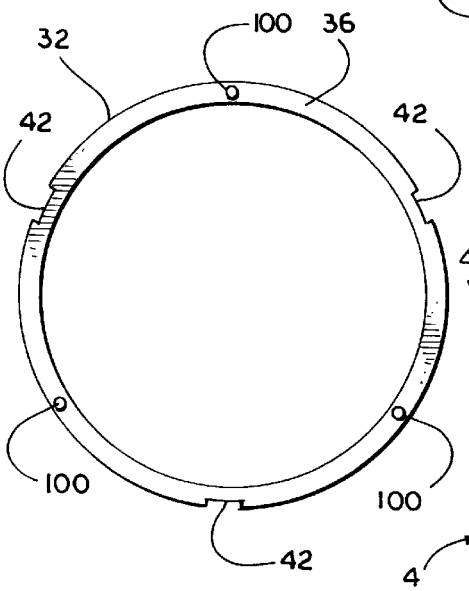
FIG. 7 is a bottom view of an embodiment of the insert member made in accordance with the present invention.

In order to mount the ring member 44 to the base member 4, the manhole extender ring system 2 utilizes a variable length, elongate stabilizer bracket 70. One embodiment of the stabilizer bracket 70 is shown in FIGS. 4 and 5. The stabilizer bracket 70 has a J-shaped arm 72 and a C-shaped arm 74. Comprising the J-shaped arm 72 is a first bracket surface 76, a J-shaped end 78 and a notched end 80 having a plurality of parallel and equidistantly-spaced notches 82 extending from the first bracket surface 76. The C-shaped arm 74 comprises a second bracket surface 84, a C-shaped end 86 and a toothed end 88 having a plurality of parallel and equally distant spaced teeth 90 extending from the second bracket surface 84 to removably and matingly engage the notches 82. Disposed between the ends 78 and 80 of the J-shaped arm 72 and proximate the notched end 80 is a first slot 92, and disposed between the ends 86 and 88 of the C-shaped arm 74 and proximate the toothed end 88 is a second slot 94, which is adapted to be adjacent to the first slot 92. The arms 72 and 74 of the stabilizer bracket 70 are fastened together by selecting the desired length of the stabilizer bracket 70, mating the notches 82 with the teeth 90 and activating a fastening means through the first and second slots 92 and 94. The fastening means can be set screws, pins, nuts and bolts and, preferably, a pop-rivet 96. More preferred is at least two pop-rivets 96 activated through the slots 92 and 94. As shown in FIG. 4, the stabilizer bracket 70 is disposed through the outer and inner channels 42 and 56. The J-shape end 78 removably engages the shoulder 60 and the C-shaped end 86 removably engages the flange 24. As long as the insert member 32 is properly seated within the base member 4, the stabilizer bracket 70 retains the ring member 44 in contact with the base member 4.

Referring again to FIG. 3, the manhole extender ring system 2 is adaptable for roadway surfaces which are not parallel to the rim surface 16. The insert top surface 34 and the ring top surface 46 can each be selected having a slope which is substantially parallel to the slope of the roadway surface formed with respect to the rim surface 16.

As additional roadway surfaces are added to the roadway, the insert and ring members 32 and 44 can be successively, vertically stacked. By stacking the insert and ring members 32 and 44, the distal ring top surface 46 is capable of remaining substantially flush with the roadway surface. Also, as roadway surfaces are removed, the stacked members 32 and 44 can be successively removed so the ring top surface 46 is maintained substantially flush with the roadway surface. Thin ring members 44 should be placed within the stack and not as the last ring member 44.

Figure 6:
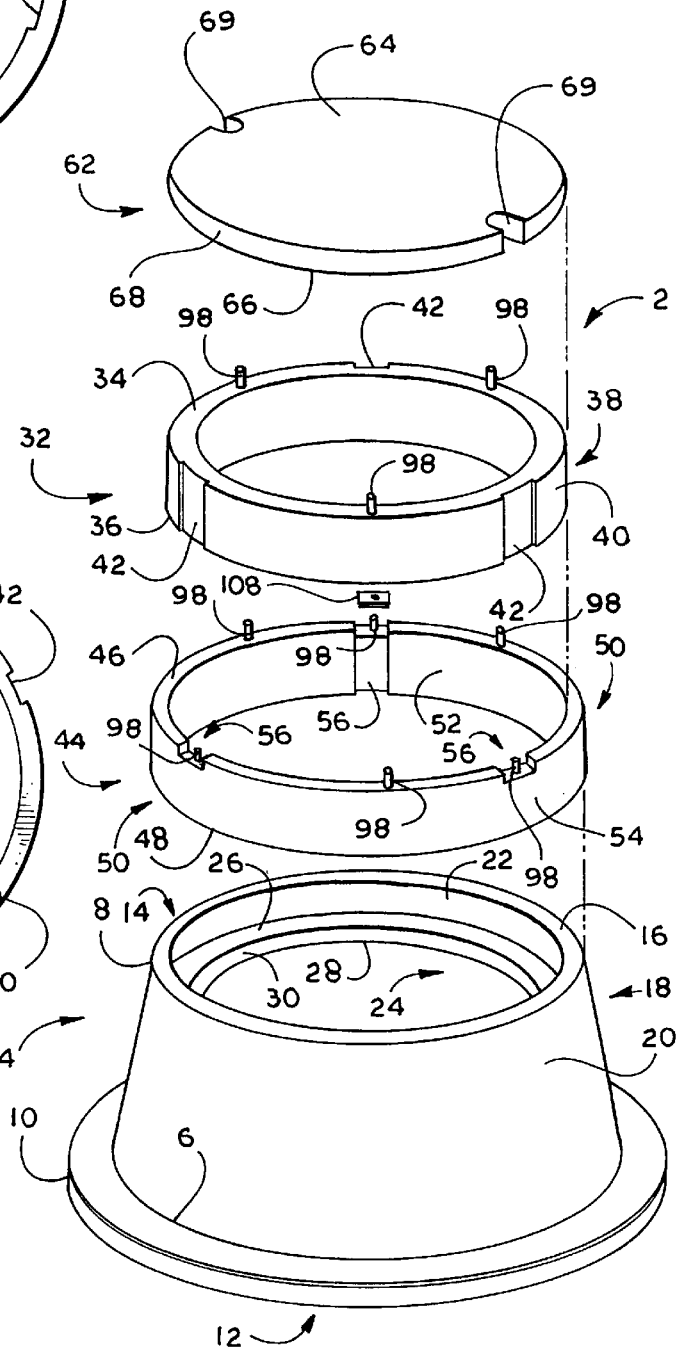
FIG. 6 is an exploded, perspective view of another embodiment of the manhole extender ring system made in accordance with the present invention.

As shown in FIG. 6, vertical stability of the manhole extender ring system 2 can be enhanced by a pin 98 and receiving bore 100 configuration. Multiple stacking of the insert and ring members 32 and 44 can cause horizontal sheer stresses being placed upon the stabilizer bracket 70. As the roadway surface is being installed, pressure is applied to the manhole extender ring system 2 from roadway surfacing equipment installing the roadway material. However, the pressure is not evenly applied across the system 2. Because the pressure is uneven, the insert and ring members 32 and 44 tend to move horizontally and exert sheering stresses onto the installed stabilizer brackets 70, which can cause the stabilizer brackets 70 to fail. By utilizing the pin and receiving bore 98 and 100 arrangement, the pins 98 receive the sheering stresses and prevent horizontal movement of the insert and ring members 32 and 44.

Pins 98 are located on the insert and ring top surfaces 34 and 46 and within the grooves 58 of the ring member 44. Preferably, the pins 98 are equal-distantly spaced from one another on the insert and ring members 32 and 44, respectively. The insert and ring members 32 and 44 may be manufactured with the pins 98 as a continuous feature thereof and extending outwardly therefrom. Also, the insert and ring members 32 and 44 may be manufactured with pin bores (not shown) on the insert and ring top surfaces 34 and 46 and within the grooves 58 of the ring member 44 so that the pins 98 can be inserted into the pin bores. The receiving bores 100 are arranged on the respective insert and ring bottom surfaces 36 and 48. Preferably, the receiving bores 100 are equal-distantly spaced apart and are positioned to matingly and removably engage the pins 98 of the preceding, stacked insert or ring members 32 and 44, respectively. The pins 98 of the final insert and ring members 23 and 44 that are placed in the stacked arrangement should be removed.

Figure 10:
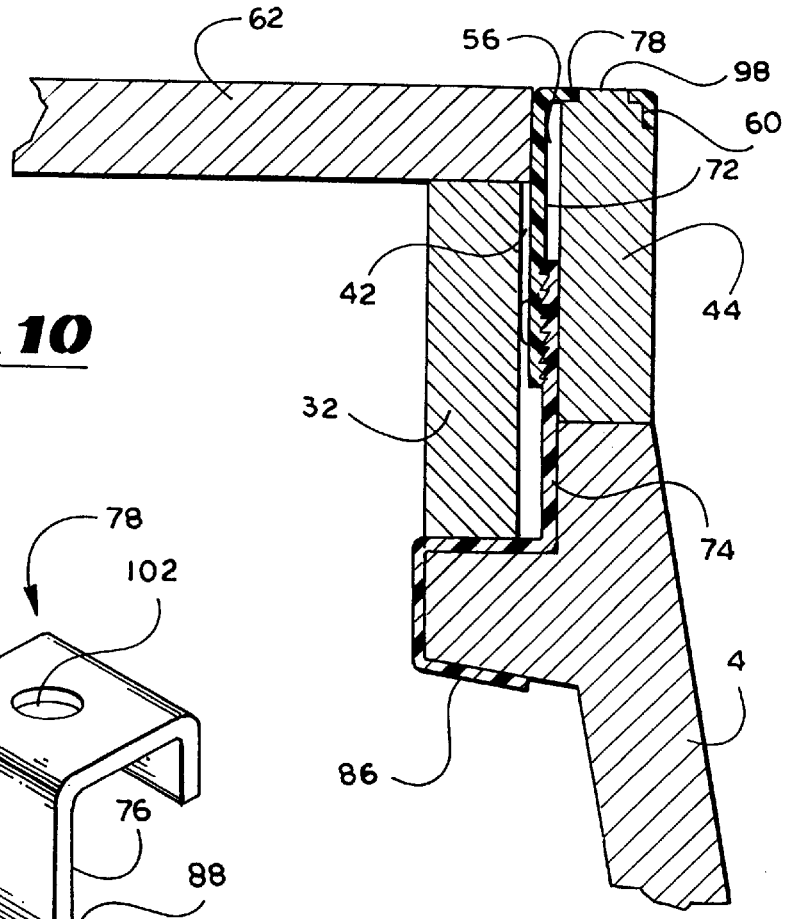
FIG. 10 is a partial and sectional side view taken along the diameter of the base member with the stabilizer bracket of FIG. 9.
Figure 9:
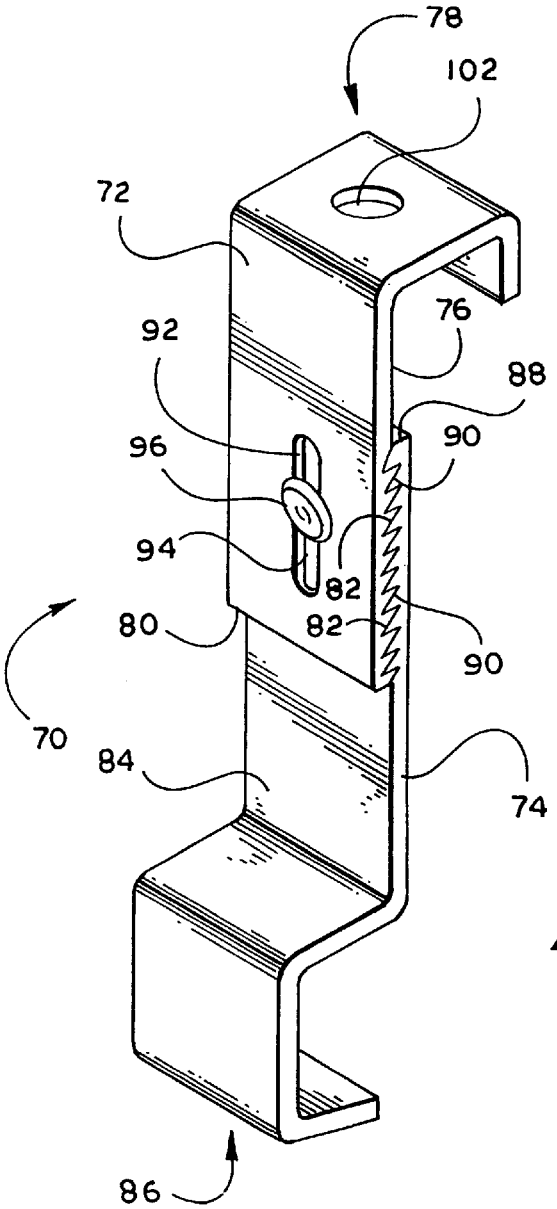
FIG. 9 is a perspective view of another embodiment of the stabilizer bracket of the present invention.

Referring now to FIGS. 9 and 10, the stabilizer bracket 70 has a bracket bore 102 at the J-shaped end 78 for removably engaging the pin 98 disposed within the groove 58. As particularly shown in FIG. 10, the manhole extender ring system 2 is assembled in the same manner as described above.

Figure 12:
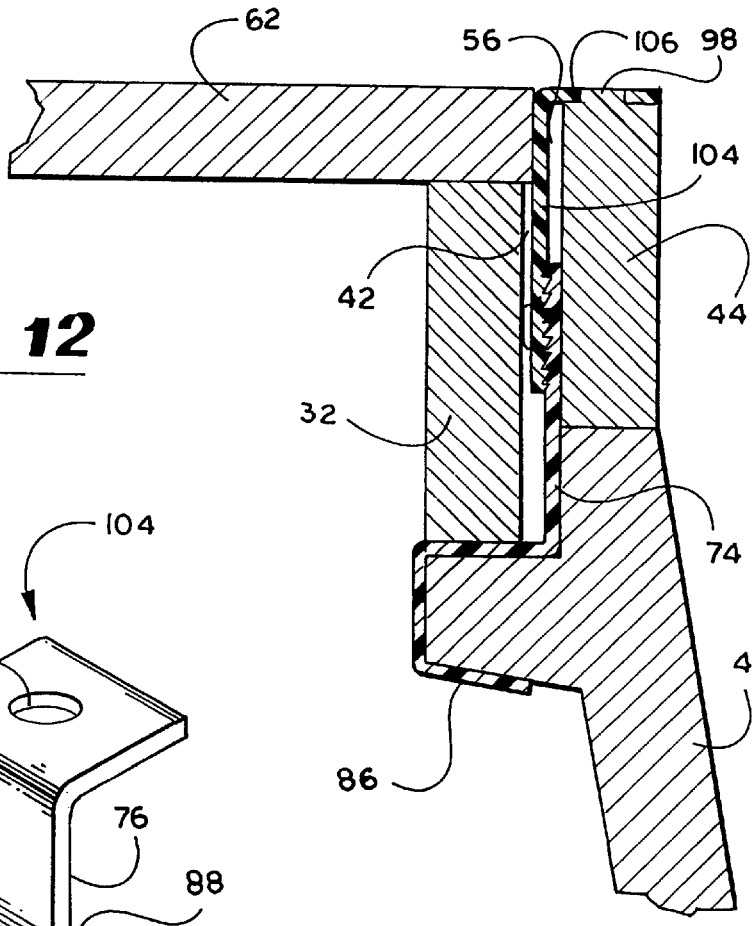
FIG. 12 a partial and sectional side view taken along the diameter of the base member with the stabilizer bracket of FIG. 11.
Figure 11:
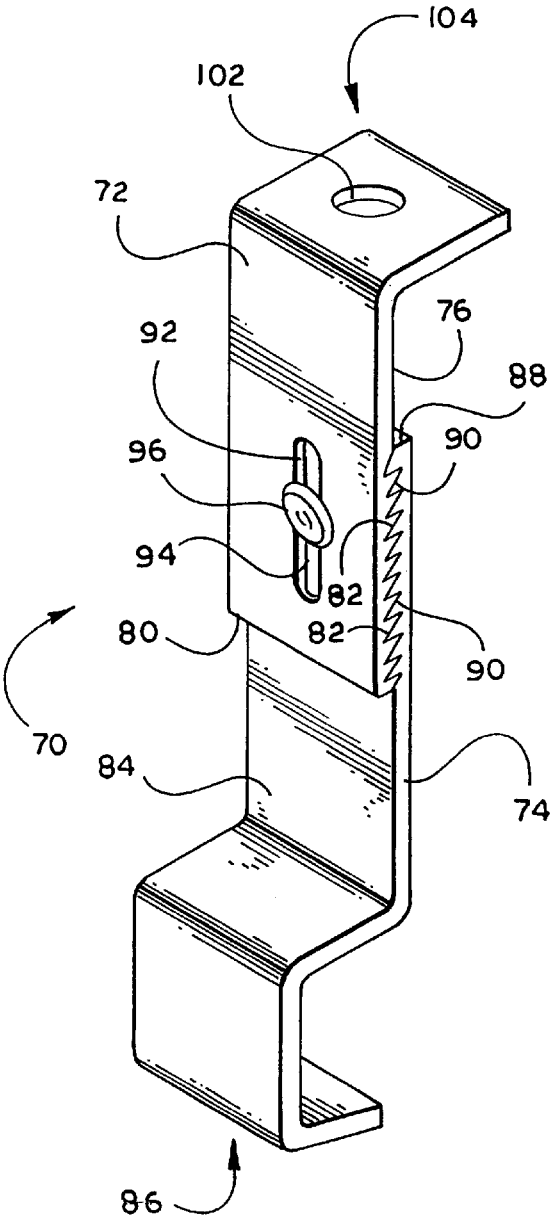
FIG. 11 is a perspective view of yet another embodiment of the stabilizer bracket of the present invention.

The embodiment of the stabilizer bracket 70 shown in FIG. 11 has an L-shaped arm 104 and a L-shaped end 106 opposite the notched end 80. Located at the L-shaped end 106 is the bracket bore 102. Referring now to FIG. 12, this embodiment of the ring member 44 has a groove 58, but it does not have a shoulder 60. The bracket bore 102 at the L-shaped end 106 removably engages the pin 98 within the groove 58 while the C-shaped end 86 removably engages the flange 24.

Figure 13:
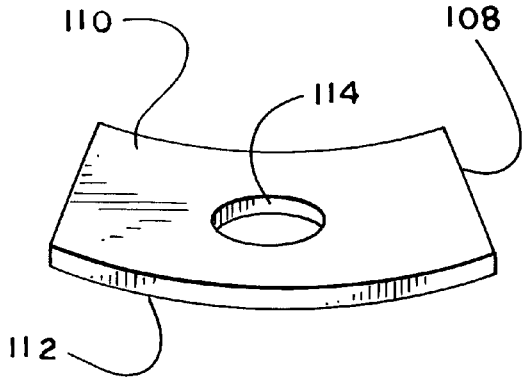
FIG. 13 is an embodiment of a tab made in accordance with the present invention.
Figure 14:
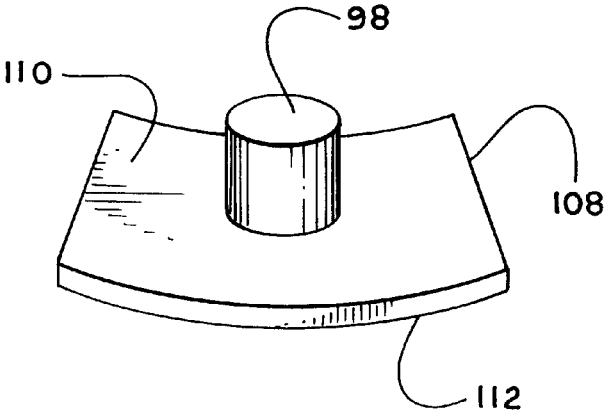
FIG. 14 is another embodiment of a tab made in accordance with the present invention.
Figure 15:
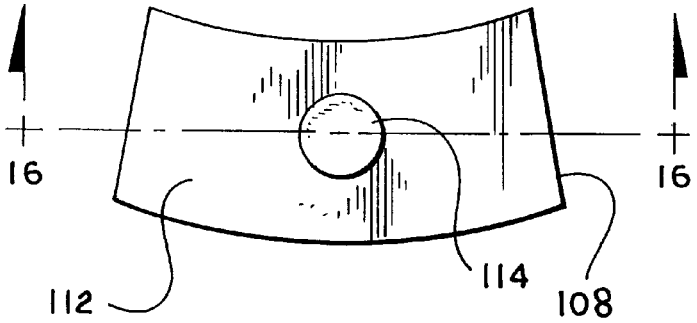
FIG. 15 is a bottom view of the tab of FIG. 14.
Figure 16:
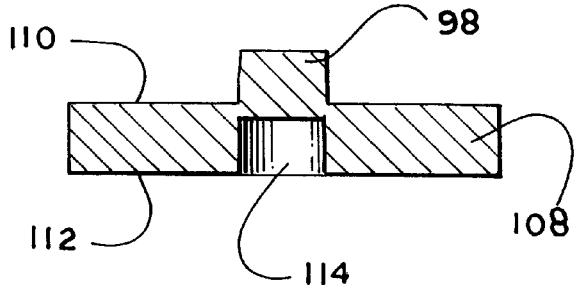
FIG. 16 is a cross-sectional view of the tab of FIG. 14 taken along line 16—16 in FIG. 15.

Referring to FIGS. 6 and 13 through 16, tabs 108 can be utilized with the manhole extender ring system 2 when there is multiple stacking of the insert and ring members 32 and 44 to prevent roadway materials from entering the grooves 56. The tab 108 has a substantially planar tab top surface 110, a substantially planar tab bottom surface 112 and a tab bore 114. When the tab 108 is placed within the groove 56, the tab top surface 110 is substantially flush with the ring top surface 46 and the tab bore 114 removably engages the pin 98. In one embodiment of the tab 108, as shown in FIG. 13, the tab bore 114 extends through the tab 108 proximate the center of the tab 108. Another embodiment of the tab 108, as shown in FIGS. 14 through 16, has the pin 98 to provide additional vertical stability. The pin 98 extends upwardly from the tab top surface 110 and is concentrically aligned with the tab bore 114, which is disposed in conjunction with the tab bottom surface 112 as shown in FIGS. 15 and 16.

The insert and ring members 32 and 44 are readily adaptable and useable with prior art base members (not shown), as long as the prior art base member has a ledge (not shown) on its upper most portion or a flange (not shown) contained within the prior art base member. This method is accomplished by removing the prior art cover member (not shown), engaging the ring member 44 with the prior art base member, attaching a stabilizer bracket 70 to the shoulder 60 of the ring member 44, inserting the insert member 32 within the prior art base member, placing the prior art cover on the insert member 32 and within the ring member 44.

Members 4, 32, 44 and 62 can be made of cast iron, aluminum polycarbonate, and, preferably steel. The stabilizer bracket 70 can be made of polycarbonate, aluminum and, preferably, steel.

Various modifications may be made of the invention without departing from the scope thereof and it is desired, therefore, that only such limitations shall be placed thereon as are imposed by the prior art and which are set forth in the appended claims.

What is claimed is:

1. A manhole extender ring system, comprising:

a base member having a foot for engaging a manhole foundation, a rim surface and a base wall, the base wall having a wall inner surface and a flange depending from the wall inner surface, the flange having a flange upper surface;

a vertically adjustable insert member removably received within the base member, the insert member having an insert top surface, an insert bottom surface and an insert wall, the insert wall having an insert outer surface adapted to slidably engage the wall inner surface of the base member, and the insert bottom surface adapted to be supported by the flange upper surface;

a vertically adjustable ring member removably engaging the base member and the insert member, the ring member having a ring top surface adapted to be placed so as to be substantially flush with the surface of a roadway and a ring bottom surface adapted to removably engage the rim surface;

a cover member removably engaging the insert member and the ring member, the cover member having a cover top surface adapted to be substantially flush with the ring top surface, a cover bottom surface supported by the insert top surface and a cover edge surface adapted to slidably engage the ring inner surface;

the insert member having at least one outer channel on the insert outer surface;

the ring member having a ring inner surface and a ring outer surface, at least one inner channel on the ring inner surface adjacent to and opposite the outer channel, at least one groove on the ring top surface adjacent the inner channel and defining a shoulder within the groove located inwardly from the ring outer surface and below the ring top surface; and an elongate stabilizer bracket disposed within the outer and inner channels having a J-shaped end removably engaging the shoulder and a C-shaped end removably engaging the flange.

2. A manhole extender ring system as claimed in claim 1, wherein the stabilizer bracket length is adjustable.

3. A manhole extender ring system as claimed in claim 2, wherein the stabilizer bracket comprises:

a J-shaped arm having a first bracket surface, the J-shaped end and a notched end having at least one notch on the first bracket surface;

a C-shaped arm having a second bracket surface, the C-shaped end and a toothed end having at least one tooth depending from the second bracket surface to removably and matingly engage the notch; and a fastening means to connect the J-shaped arm to the C-shaped arm.

4. A manhole extender ring system as claimed in claim 3, wherein the fastening means comprises the J-shaped arm having a first slot proximate the notched end, the C-shaped arm having a second slot proximate the tooth end and adjacent the first slot, and at least one pop-rivet engaging the J-shaped arm and the C-shaped arm through the first and second slots.

5. A manhole extender ring system as claimed in claim 1, wherein the at least one groove has a pin extending outwardly from the at least one groove and the J-shaped end of the stabilizer bracket has a bracket bore to removably engage the pin.

6. A manhole extender ring system as claimed in claim 5, wherein the at least one groove has a pin bore and the pin removably engages the pin bore.

7. A manhole extender ring system as claimed in claim 5, wherein the stabilizer bracket has a L-shaped end and the L-shaped end has the bracket bore for removably engaging the pin.

8. A manhole extender ring system, comprising:

a base member having a foot for engaging a manhole foundation, a rim surface and a base wall, the base wall having a wall inner surface and a flange depending from the wall inner surface, the flange having a flange upper surface;

a vertically adjustable insert member removably received within the base member, the insert member having an insert top surface, an insert bottom surface and an insert wall, the insert wall having an insert outer surface adapted to slidably engage the wall inner surface of the base member, and the insert bottom surface adapted to be supported by the flange upper surface;

a vertically adjustable ring member removably engaging the base member and the insert member, the ring member having a ring top surface adapted to be placed so as to be substantially flush with the surface of a roadway and a ring bottom surface adapted to removably engage the rim surface;

a cover member removably engaging the insert member and the ring member, the cover member having a cover top surface adapted to be substantially flush with the ring top surface, a cover bottom surface supported by the insert top surface and a cover edge surface adapted to slidably engage the ring inner surface;

two or more each of the insert and ring members positioned within and on, respectively, the insert member abutting the base member in vertically stacked relationship;

a mounting means for attaching the ring members to the base members;

all insert members having at least one outer channel on the insert outer surface;

all ring members having a ring outer surface, at least one inner channel on the ring inner surface adjacent to the outer channel, at least one groove on the ring top surface adjacent the inner channel and defining a shoulder within the groove located inwardly from the ring outer surface and below the ring top surface; and an elongate stabilizer bracket disposed within the outer and inner channels having a J-shaped end removably engaging the shoulder and a C-shaped end removably engaging the flange.

9. A manhole extender ring system as claimed in claim 8, wherein the stabilizer bracket length is adjustable.

10. A manhole extender ring system as claimed in claim 9, wherein the stabilizer bracket comprises:

a J-shaped arm having a first bracket surface, the J-shaped end and a notched end having at least one notch on the first bracket surface;

a C-shaped arm having a second bracket surface, the C-shaped end and a toothed end having at least one tooth depending from the second bracket surface to removably and matingly engage the notch; and a fastening means to connect the J-shaped arm to the C-shaped arm.

11. A manhole extender ring system as claimed in claim 10, wherein the fastening means comprises the J-shaped arm having a first slot proximate the notched end, the C-shaped arm having a second slot proximate the tooth end and adjacent the first slot, and at least one pop-rivet engaging the J-shaped arm and the C-shaped arm through the first and second slots.

* * * * *